US006847928B1

(12) United States Patent
Naka

(10) Patent No.: US 6,847,928 B1
(45) Date of Patent: Jan. 25, 2005

(54) SPEECH DECODER AND SPEECH DECODING METHOD

(75) Inventor: Nobuhiko Naka, Kanagawa (JP)

(73) Assignee: NTT Mobile Communications Network, Inc., Tokyo (JP)

( * ) Notice: Subject to any disclaimer, the term of this patent is extended or adjusted under 35 U.S.C. 154(b) by 0 days.

(21) Appl. No.: 09/462,127

(22) PCT Filed: May 27, 1999

(86) PCT No.: PCT/JP99/02802

§ 371 (c)(1),
(2), (4) Date: Dec. 29, 1999

(87) PCT Pub. No.: WO99/62056

PCT Pub. Date: Dec. 2, 1999

(30) Foreign Application Priority Data

May 27, 1998 (JP) ..... 10-146193

(51) Int. Cl.[7] ..... G10L 19/12

(52) U.S. Cl. ..... 704/223; 704/226; 704/228; 704/224; 375/232; 714/747

(58) Field of Search ..... 704/226, 228, 704/224, 219, 232, 262; 714/747; 375/232

(56) References Cited

U.S. PATENT DOCUMENTS 4,178,549 A * 12/1979 Ledenbach ..... 325/38

(List continued on next page.)

FOREIGN PATENT DOCUMENTS

JP 02-256308 A 10/1990
JP 06-012095 A 1/1994

OTHER PUBLICATIONS

IEEE Transactions on Speech and Audio Processing, vol. 6, No. 2, Mar. 1998, Red Salami et al., "Design and Description of CS–ACELP: A Toll Quality 8 kb/s Speech Coder", pp. 116–130.

*Primary Examiner*—Richemond Dorvil
*Assistant Examiner*—Qi Han
(74) *Attorney, Agent, or Firm*—Brinks Hofer Gilson & Lione

(57) ABSTRACT

A decoding processing portion 11 of a speech decoder 10 is provided with an emphasis processing portion 15 for performing an emphasis process on signals to be processed (excited signals) SPC generated from coded speech signals BS. A counter portion 17 counts the number of times code errors occurred in successive frames of the coded speech signal BS, and outputs the successive frame error number. When the successive frame error number outputted form the counter portion 17 is less than or equal to a preset reference successive frame error number, a first switch SW1 and second switch SW2 are set to an emphasis processing portion 15 side. Accordingly, the signals to be processed SPC generated from various parameters included in the coded speech signals are supplied through the switch SW1 to the emphasis processing portion 15 of the decoding processing portion 11 to perform an emphasis process. Then, the emphasized signals to be processed SEPC obtained by this emphasis process are outputted through the switch SW2 to latter connected devices. As a result, decoded speech signals SP with good subjective sound quality are obtained. On the other hand, when the communication quality is degraded and the successive frame error number outputted from the counter portion 17 exceeds a preset reference successive frame error number, the first switch SW1 and second switch SW2 are set to a bypass BP side. Accordingly, the signals to be processed SPC generated from the various parameters contained in the coded speech signals are outputted to the latter connected devices without emphasis processing by the emphasis processing portion 15. In this way, emphasis processing is prohibited when the successive frame error number is large, thereby reducing distortion generated in the decoded speech signals SP.

10 Claims, 4 Drawing Sheets

U.S. PATENT DOCUMENTS 5,283,811 A * 2/1994 Chennakeshu et al. ..... 708/323
5,305,332 A * 4/1994 Ozawa ..... 371/31
5,581,651 A * 12/1996 Ishino et al. ..... 395/214
5,644,597 A * 7/1997 Ueda ..... 375/229
5,673,363 A * 9/1997 Jeon et al. ..... 704/206
5,699,485 A * 12/1997 Shoham ..... 704/223
5,732,389 A * 3/1998 Kroon et al. ..... 704/223
6,085,158 A * 7/2000 Naka et al. ..... 704/228

* cited by examiner

SPEECH DECODER AND SPEECH DECODING METHOD

TECHNICAL FIELD

The present invention relates to a speech decoder and speech decoding method used in speech CODECs.

BACKGROUND ART

Audio decoders which generate excited signals from coded speech signals input in units of frames and generate decoded speech signals from these excited signals are known. Of these types of speech decoders, in those which are adapted to low bit rate speech CODECs, the excited signals are treated with emphasis processing such as pitch emphasis processing or formant emphasis processing in order to improve the subjective sound quality of the decoded speech.

However, when frame errors occur in succession, the noise components are emphasized by these emphasis processes, thereby increasing the distortion and lowering the subjective sound quality.

DISCLOSURE OF THE INVENTION

The present invention has been accomplished in view of the above considerations, and has the object of offering a speech decoder and speech decoding method capable of lessening the reduction of the subjective sound quality even when fame errors occur in succession.

In order to achieve this object, the present invention offers a speech decoder which generates excited signals from coded speech signals inputted in units of frames and generates decoded speech signals from these excited signals, characterized by comprising emphasis processing means for performing an emphasis process on said excited signals; error detecting means for detecting frame errors in said coded speech signals; counting means for counting a number of times said frame errors occurred in succession and outputting the successive error frame number; and emphasis process prohibiting means for prohibiting said emphasis process due to said emphasis processing means when said successive error frame number exceeds a predetermined reference error frame number.

According to this speech decoder, an emphasis process is performed on the excited signals when the communication environment is good, and the successive error frame number is less than or equal to a predetermined reference error frame number. As a result, good decoded speech signals with high subjective sound quality are obtained. On the other hand, if the communication environment becomes bad and the successive error frame number exceeds the reference error frame number, the emphasis processing of the excited signals is prohibited. Therefore, distortions in the decoded speech signals which occur when emphasis processing is performed in such cases can be avoided before they occur.

Additionally, aside from prohibiting emphasis processing of excited signals when the successive error frame number has exceeded the reference error frame number, it is possible to control the amount of emphasis in the emphasis process in accordance with the successive error frame number.

BEST MODES FOR CARRYING OUT THE INVENTION

Next, a preferred embodiment of the present invention shall be described with reference to the drawings.

Figure 1:
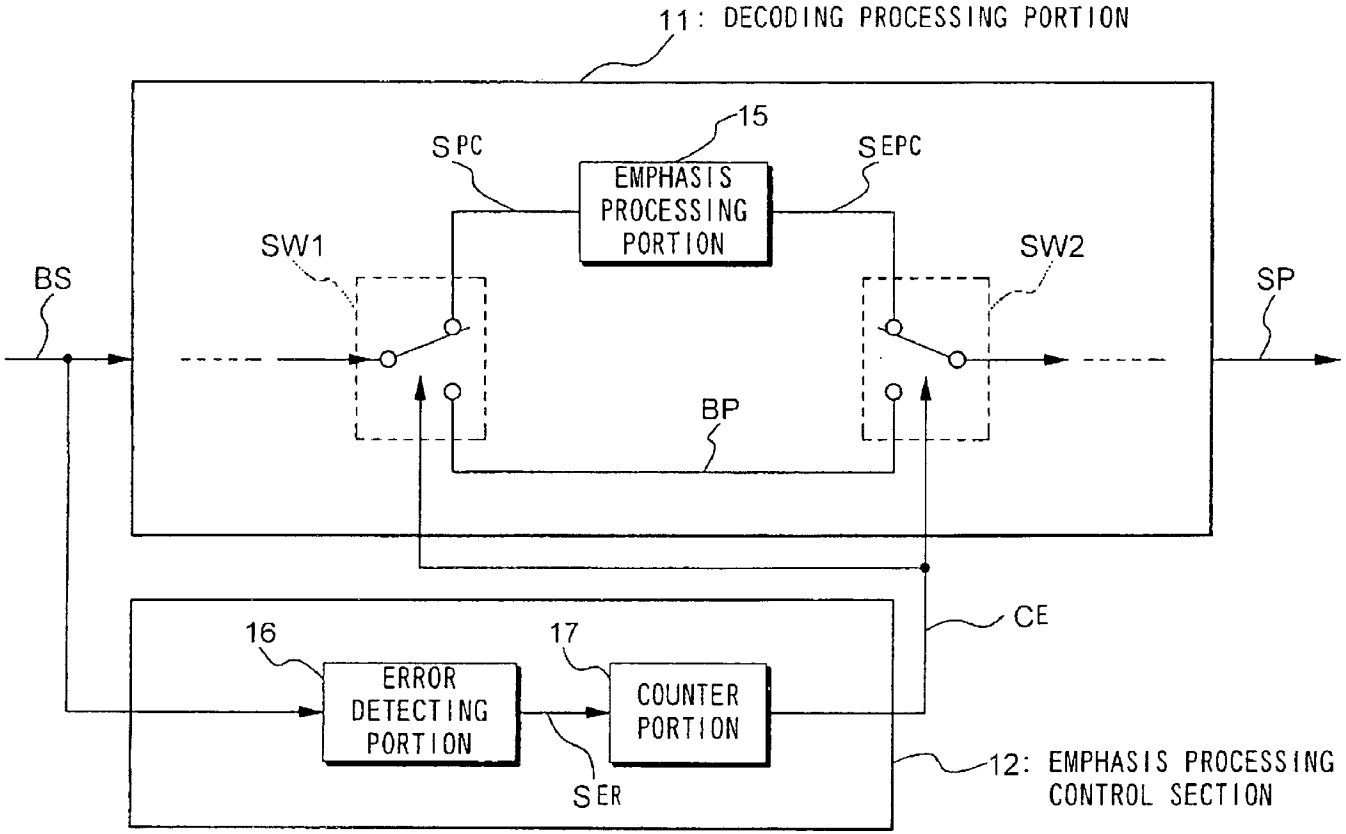
FIG. 1 is a block diagram showing the structure of a speech decoder which is an embodiment of the present invention.

FIG. 1 is a block diagram showing the structure of a speech decoder 10 which is an embodiment of the present invention.

This speech decoder 10 comprises a decoding processing portion 11 and a emphasis process control portion 12.

Here, the decoding processing portion 11 is a device for decoding the received coded speech signals (bitstream) BS and outputting the decoded speech signals SP.

This decoding processing portion 11 comprises an emphasis processing portion 15, a first switch SW1 and a second switch SW2.

The emphasis processing portion 15 performs emphasis processing with respect to the signals to be processed SPC based on the various parameters contained in the decoded speech signal, and outputs the resulting emphasized signals to be processed SEPC.

The first switch SW1 and second switch SW2 are switches for switching the signals to be processed SPC so as to be supplied to the latter-stage circuits through the emphasis processing portion 15, or so as to be supplied to the latter-stage circuits through the bypass BP.

Next, the emphasis process control portion 12 is a device for controlling whether or not to perform the emphasis processes in the decoding processing portion 11 based on frame error conditions of the coded speech signal BS.

This emphasis process control portion 12 comprises an error detecting portion 16 and a counter portion 17.

Here, the error detecting portion 16 is a device for detecting the frame errors of the coded speech signal BS and outputting error detection signals SER.

Additionally, the counter portion 17 counts the successive frame error number based on the error detection signals SER, and outputting an emphasis process control signal CE for switching the first switch SW1 and the second switch SW2 to the bypass BP side to prohibit emphasis processing when the successive frame error number exceeds a preset reference successive frame error number.

Next, the operations of the present embodiment will be described.

First, when the successive frame error number outputted from the counter portion 17 is less than or equal to a preset reference successive frame error number, the first switch SW1 and second switch SW2 are set to the emphasis process portion 15 side. Therefore, signals to be processed SPC generated from various parameters contained in the coded speech signal BS are supplied to the emphasis processing portion 15 of the decoding processing portion 11 via the first switch SW1 for emphasis processing. Then, the emphasized signals to be processed SEPC obtained by this emphasis process are outputted 10 the latter connected devices. As a result, a decoded speech signal SP with good subjective sound quality is obtained.

On the other hand, when the communication quality is degraded and the successive frame error number outputted from the counter portion 17 exceeds the reference successive frame error number, the first switch SW1 and second switch SW2 are set to the bypass BP side. As a result, the signals to be processed SPC generated by the parameters contained in the coded speech signal BS are outputted to latter-connected devices without being emphasis processed by the emphasis processing portion 15. Since the emphasis process is prohibited in this way when the successive frame error number is large, it is possible to reduce distortions generated by in the decoded speech signals SP.

Figure 2:
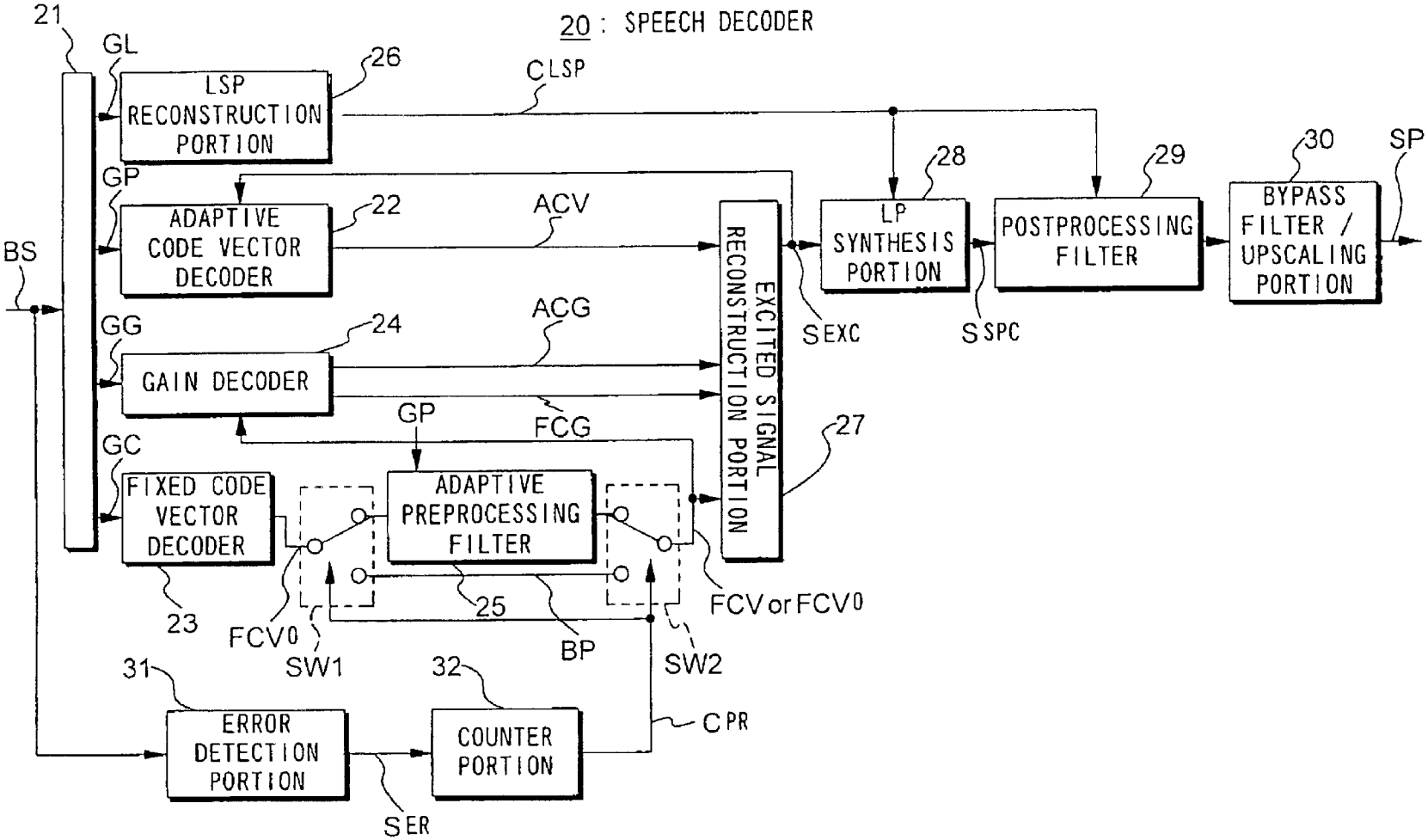
FIG. 2 is a block diagram showing a specific structure applying the same embodiment to a CS-ACELP type speech decoder.

Next, with reference to FIG. 2, a specific example of application of the present embodiment to a speech decoder in a CS-ACELP (Conjugate Structure Algebraic Code Excited Linear Prediction) type CODEC shall be explained. This type of CS-ACELP format speech coder and speech decoder are described, for example, in R. Salam et al., "Design and Description of CS-ACELP: A Toll Quality 8 kb/s Speech Coder", IEEE Trans. on Speech and Audio Processing, vol. 6, no. 2, March 1998.

In FIG. 2, the speech decoder 20 comprises a parameter decoder 21. This parameter decoder 21 is a device decoding a pitch delay parameter group GP, a cobebook gain parameter group GG, a codebook index parameter group GC and an LSP (Line Spectrum Pair) index parameter group GL from the received coded speech signals (bitstream) BS.

Here, the codebook index parameter group GC includes a plurality of codebook index parameters and a plurality of codebook code parameters.

Additionally, the speech decoder 20 comprises an adaptive code vector decoder 22, a fixed code vector decoder 23 and an adaptive preprocessing filter 25.

Here, the adaptive code vector decoder 22 is a device for outputting an adaptive code vector ACV corresponding to the pitch delay parameter group GP. More specifically, this adaptive code vector decoder 22 has a rewritable memory, and this memory contains a predetermined number of adaptive code vectors ACV which have been input in the past. The adaptive code vector decoder 22 takes the pitch delay parameter group GP as an index, reads an adaptive code vector ACV corresponding to this index from the memory, and outputs the result. Additionally, when the excited signal SEXC is reconstructed by the excited signal reconstruction portion 27 to be described later, this excited signal SEXC is written into the memory of the adaptive code vector decoder 22 as a new adaptive code vector ACV, and the oldest adaptive code vector ACV in the memory is eliminated.

The fixed code vector decoder 23 is a device for outputting an original fixed code vector FCV0 corresponding to the codebook index parameter group GC.

The adaptive preprocessing filter 25 is a device which functions as an emphasizing process means for emphasizing the harmonic components of the original fixed code vector FCV0, and outputs the result as a fixed code vector FCV.

Here, the first switch SW1 is provided in front of the adaptive preprocessing filter 25 in order to switch whether to supply the original fixed code vector FCV0 outputted from the fixed code vector decoder 23 to be supplied to the adaptive preprocessing filter 25 or to be supplied to the bypass BP. Additionally, the second switch SW2 is provided after the adaptive preprocessing filter 25 to select either the output terminal of the adaptive preprocessing filter 25 or the bypass BP for connection to the excited signal reconstruction portion 27. The first switch SW1 and second switch SW2 are switched by means of a preprocessing control signal CPR to be described later.

Furthermore, the speech decoder 20 comprises a gain decoder 24 and an LSP reconstruction portion 26.

The gain decoder 24 is a device for outputting an adaptive codebook gain ACG and a fixed codebook gain FCG based on a fixed code vector FCV (or original fixed code vector FCV0) and a codebook gain parameter group GG.

The LSP reconstruction portion 26 is a device for reconstructing the LSP coefficient CLSP based on the LSP index parameter group GL.

Further, the speech decoder 20 comprises an excited signal reconstruction portion 27, an LP synthesis filter 28, a postprocessing filter 29 and a bypass filter/upscaling portion 30.

Here, the excited signal reconstruction portion 27 is a device for reconstructing the excited signal SEXC based on adaptive code vector ACV, an adaptive codebook gain ACG, a fixed codebook gain FCG and a fixed code bector FCV (or original fixed code vector FCV0). This excited signal SEXC is written into the memory of the adaptive code vector decoder 22 as a new adaptive code vector ACV, and the oldest adaptive code vector ACV in the memory is eliminated.

The LP synthesis filter 28 is a device which performs an LP synthesis based on the excited signal SEXC and the LSP coefficient CLSP to reconstruct the speech signal SSPC.

The postprocessing filter 29 is a device for performing postprocess filtering of the speech signal SPC. This postprocessing filter 29 is constructed of three filters, a long-term postprocessing filter, a short-term postprocessing filter and a slope compensation filter. These three filters are serially connected in the order of long-term postprocessing filter to short-term postprocessing filter to slope compensation filter in the direction of input to output.

The bypass filter/upscaling portion 30 is a device for performing a bypass filtering process and an upscaling process with respect to the output signals of the postprocessing filter 29.

Additionally, the speech decoder 20 comprises an error detecting portion 31 and a counter portion 32.

Here, the error detecting portion 31 detects frame errors in the received coded speech signals BS and outputs error detection signals SER.

Additionally, the counter portion 32 counts the successive frame error number based on the error detection signal SER, outputs a preprocessing control signal CPR for selecting the preprocessing filter 25 by means of the first switch SW1 and the second switch SW2 when the successive frame error number is less than or equal to a predetermined reference frame error number, and outputs a preprocessing control signal CPR for selecting the bypass BP by means of the first switch SW1 and the second switch SW2 when the successive frame error number has exceeded the predetermined reference frame error number.

Next, the operations of the speech decoder 20 shall be explained.

First, when the successive frame error number is less than or equal to the reference frame error number, the counter portion 32 switches the first switch SW1 and second switch SW2 to the adaptive preprocessing filter 25 by means of a preprocessing control signal CPR. As a result, the original fixed code vector FCV0 outputted from the fixed code vector decoder 23 is supplied to the adaptive preprocessing filter 25. Then, an emphasis process for emphasizing the harmonic components is performed on the original fixed code vector FCV0 in the adaptive preprocessing filter 25, and the resulting fixed code vector FCV is supplied to the gain decoder 24 and the excited signal reconstruction portion 27. Thus, a decoded speech signal SP with good subjective sound quality is obtained.

On the other hand, when the communication quality degrades and the successive frame error number outputted from the counter portion 32 exceeds the preset reference successive frame error number, the first switch SW1 and the second switch SW2 are set to the bypass BP side. As a result, the original fixed code vector FCV0 outputted from the fixed code vector decoder 23 is supplied to the gain decoder 24 and excited signal reconstruction portion 27 without undergoing an emphasis process by means of the adaptive preprocessing filter 25. Since the emphasis process is prohibited in this way when the successive frame error number is large, it is possible to reduce distortion which is generated in the decoded speech signal SP.

An embodiment of the present invention has been explained above, but various examples of modifications to this embodiment can be considered.

Figure 3:
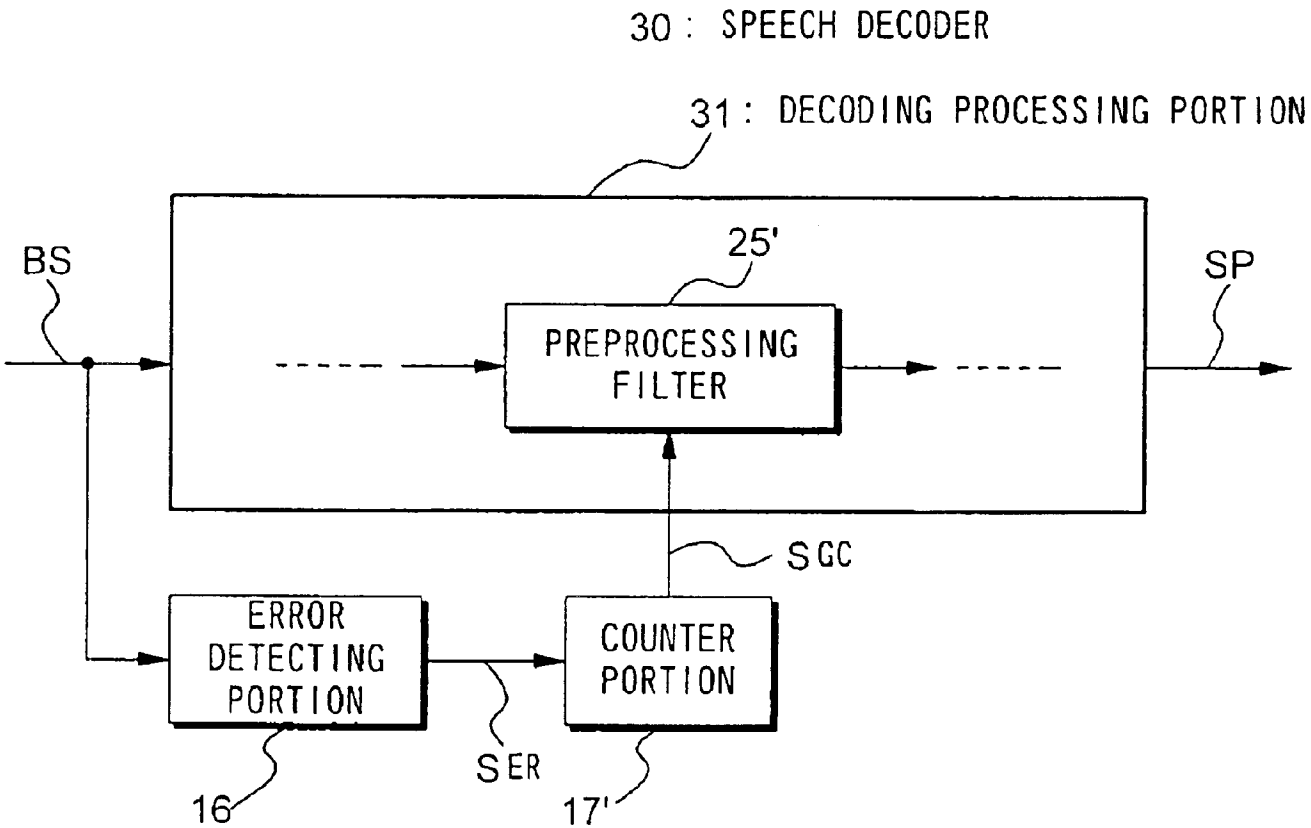
FIG. 3 is a diagram for explaining a first modification example of this embodiment.

FIG. 3 is a block diagram showing the structure of a speech decoder according to a first modification example. In FIG. 3, the parts which are the same as those in FIG. 1 are indicated by the same reference numerals.

In the above-described embodiment, emphasis processing is prohibited when the successive frame error number exceeds the predetermined reference successive frame error number. In contrast, in a speech decoder 30 according to a first modification example, the degree of the emphasis processing is controlled by controlling the filter gain of the preprocessing filter 25' for performing emphasis processing as shown in FIG. 3. That is, the counter portion 17' counts the successive frame error number, outputs a gain control signal SGC which makes the filter gain of the preprocessing filter 25' a normal value when this successive frame error number is less than or equal to a predetermined reference frame error number, and outputs a gain control signal SGC for making the filter gain of the preprocessing filter 25' less than usual when the successive frame error number exceeds the predetermined reference frame error number.

In this case as well, it is possible to reduce the distortions which are generated by performing emphasis processing when frame errors occur in succession, so as to enable the degradation of the subjective sound quality to be reduced.

Figure 4:
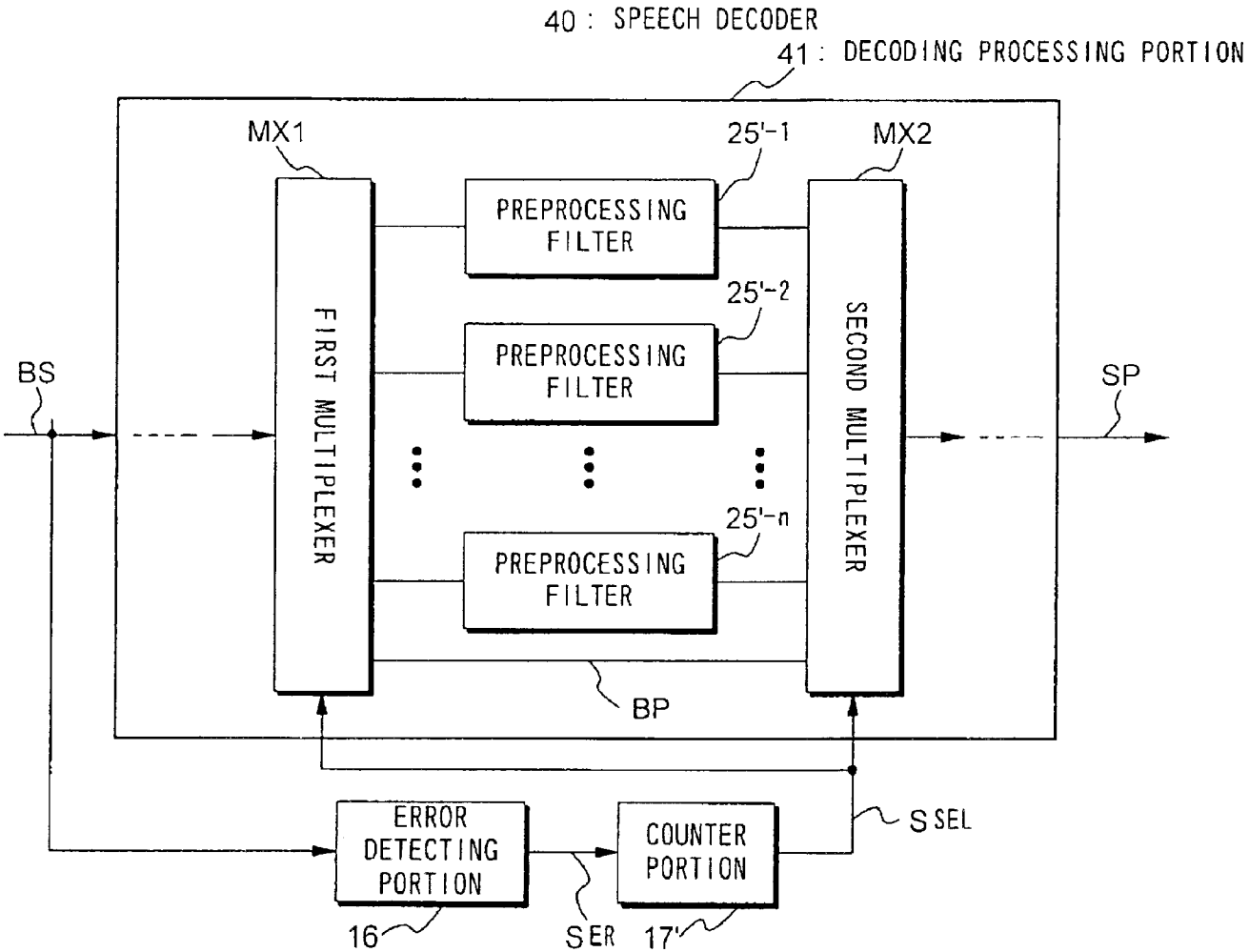
FIG. 4 is a diagram for explaining a second modification example of this embodiment.

FIG. 4 is a block diagram showing the structure of a speech decoder according to a second modification example. In FIG. 4, the parts which are the same as those in FIG. 1 are indicated by the same reference numerals.

In the speech decoder 40 of the second modification example, the deoding processing portion 41 is provided with a plurality of preprocessing filters 25'-1 to 25'-n, a first multiplexer MX1 and a second multiplexer MX2 as shown in FIG. 4.

Here, the amount of emphasis (e.g., corresponding to the filter gain) of the emphasis process performed by each of the preprocessing filters 25'-1 to 25'-n are different, the amount of emphasis in the preprocessing filter 25'-1 being the highest, and the amount of emphasis becoming lower in advancing to preprocessing filter 25'-2, preprocessing filter 25'-3 and so on. Between the first multiplexer MX1 and the second multiplexer MX2, one route is selected from among these preprocessing filters 25'-1 to 25'-n and the bypass BP.

The counter portion 17" counts the number of successive frame errors, and supplies a selection signal SSEL for selecting the bypass BP or a preprocessing filter of an emphasis amount suited to the number of successive frame errors to the first multiplexer MX1 and the second multiplexer MX2.

In this second modification example, e.g. when the successive frame error number is "0", the preprocessing filter 25'-1 with the highest amount of emphasis is selected by the first multiplexer MX1 and second multiplexer MX2.

Then, if the communication environment worsens, preprocessing filters with lower amounts of emphasis are chosen such as preprocessing filter 25'-2 preprocessing filter 25'-3, . . . as the successive frame error number increases from "0" to "1", "2", . . .

In this way, the effects of switching of emphasis processing can be reduced because the amount of emphasis of the emphasis process can be switched in multiple steps in accordance with the successive frame error number.

In the above description, a case of a CS-ACELP type speech decoder was given as a specific example of the speech signal processing device. However, the present invention can be applied to speech signal processing devices of other formats such as speech decoders using APC (Adaptive Predictive Coding), APC-AB (APC with Adaptive Bit allocation), APC-MLQ, ATC (Adaptive Transform Coding), MPC (Multi Pulse Coding), LPC (Linear Prediction Coding), RELP (Residual Excited LPC) CELP (Code Excited LPC), LSP (Line Spectrum Pair Coding) or PARCOR as long as they are speech signal processing devices which perform emphasis processing.

What is claimed is:

1. A speech decoder that decodes parameters received in frames and reconstructs a speech based on the received parameters, comprising:

a first-stage decoding circuit that generates excitation vectors from the received parameters:

a second-stage decoding circuit that performs a speech synthesis, using the excitation vectors, to obtain a reconstructed speech;

an adaptive preprocessing filter, located between the first-stage and second-stage circuits, that emphasizes, to a degree, a harmonic component of at least one of the excitation vectors; and an error frame counter that counts successive error frames that contain a transmission error, the error frame counter operably connected to the adaptive preprocessing filter to decrease the degree of emphasis performed thereby as a count of the successive error frames increases, wherein the error frame counter disables the adaptive preprocessing filter to effect zero emphasis on the at least one of the excitation vectors when the count of the successive error frames reaches a predetermined number.

2. A speech decoder according to claim 1, wherein the first-stage decoding circuit comprises an adaptive code decoder and a fixed code decoder.

3. A speech decoder according to claim 2, wherein the adaptive preprocessing filter emphasizes a harmonic component of excitation vectors output from the fixed code decoder.

4. A speech decoder according to claim 1, wherein the second-stage decoding circuit comprises a speech synthesis filter excited by the excitation vectors.

5. A speech decoder according to claim 4, wherein the second-stage decoding circuit further comprises at least one post-processing filter.

6. A speech decoder according to claim 1, wherein the adaptive preprocessing filter is configured to emphasize the harmonic component to a fixed degree and is disabled by the error frame counter when the count by the error frame counter reaches the predetermined number.

7. A speech decoder according to claim 1, where the adaptive preprocessing filters is configured to emphasize the harmonic component to variable degrees, and the error frame counter selectively effects the variable degrees of emphasis in a descending manner as the count by the error frame counter increases.

8. A speech decoder according to claim 7, wherein the adaptive preprocessing filter comprises a plurality of filters each effecting a different degree of emphasis, and the error frame counter selectively enables these filters in a descending manner as to their degrees of emphasis as the count by the error frame counter increases.

9. A speech decoder according to claims 7, wherein the adaptive preprocessing filter receives a gain input a variation of which effects variable degrees of emphasis by the adaptive preprocessing filter, and the error frame counter varies the gain input to effect different degrees of emphasis in a descending manner as the count by the error frame counter increases.

10. A speech decoder according to claim 1, wherein the speech decoder uses a coding scheme selected from a group consisting of a Conjugate Structure Algebraic Code Excited Linear Prediction (CS-ACELP) scheme, an Adaptive Predictive Coding (APC) scheme, an Adaptive Predictive Coding with Adaptive Bit Allocation (APC-AB) scheme, an APC-MLQ scheme, an Adaptive Transform Coding (ATC) scheme, a Multi Pulse Coding (MPC) scheme, a Linear Prediction Coding (LPC) scheme, a Residual Excited Linear Prediction Coding (RELP) scheme, a Code Excited Linear Prediction Coding (CELP) scheme, a Line Spectrum Pair Coding (LSP) scheme, and a PARCOR scheme.

* * * * *